US007891842B2

(12) United States Patent
Lu et al.

(10) Patent No.: US 7,891,842 B2
(45) Date of Patent: Feb. 22, 2011

(54) HEAT-DISSIPATING REFLECTOR FOR LIGHTING DEVICE

(75) Inventors: Ming Lu, Sijhih (TW); Kai Chiu Wu, New Territories (HK); Lei Shi, Kowloon (HK); Lai Man Chau, Shatin (HK)

(73) Assignee: Hong Kong Applied Science and Technology Research Institute Co. Ltd., Shatin, New Territories (HK)

( * ) Notice: Subject to any disclaimer, the term of this patent is extended or adjusted under 35 U.S.C. 154(b) by 144 days.

(21) Appl. No.: 12/188,146

(22) Filed: Aug. 7, 2008

(65) Prior Publication Data

US 2010/0033971 A1 Feb. 11, 2010

(51) Int. Cl.
*F21V 29/00* (2006.01)

(52) U.S. Cl. ..... 362/267; 362/294; 362/373

(58) Field of Classification Search ..... 362/294, 362/373, 267, 306, 310
See application file for complete search history.

(56) References Cited

U.S. PATENT DOCUMENTS

| | | | | |
|---|---|---|---|---|
| 6,210,024 | B1 * | 4/2001 | Shida | 362/345 |
| 6,491,413 | B1 * | 12/2002 | Benesohn | 362/294 |
| 6,840,654 | B2 * | 1/2005 | Guerrieri et al. | 362/241 |
| 7,682,054 | B2 * | 3/2010 | Hsu et al. | 362/373 |

* cited by examiner

*Primary Examiner*—John A Ward
(74) *Attorney, Agent, or Firm*—Berkeley Law & Technology Group, LLP

(57) ABSTRACT

A heat-dissipating reflector for a lighting device having a reflecting surface for reflecting light from a light emitting source of the lighting device, and a plurality of ventilation openings formed through the reflecting surface for dissipating heat generated by the light emitting source.

14 Claims, 5 Drawing Sheets

HEAT-DISSIPATING REFLECTOR FOR LIGHTING DEVICE

BACKGROUND

Conventional lighting devices usually contain light reflecting means located at the front/top portion thereof for directing light towards one direction, and a separate heat spreading/dissipating means located at a rear/bottom portion thereof for ventilating heat towards an opposite direction. These conventional lighting devices are usually complicated in construction, difficult to manufacture, and do not achieve an effective light reflecting and heating spreading/dissipation performance.

Therefore, it would be desirable to provide an improved lighting device that is simple in construction, easy to manufacture, and achieves an effective light reflecting and heat spreading/dissipation performance.

SUMMARY

According to one aspect, there is provided a heat-dissipating reflector for a lighting device including a body having a reflecting surface for reflecting light from a light emitting source of the lighting device, and a plurality of ventilation openings formed through the reflecting surface for dissipating heat generated by the light emitting source.

In one embodiment, the body includes a generally truncated conical body having a major end and a minor end. The reflecting surface is formed on an inner circumferential surface of the truncated conical body.

In one embodiment, the body has a plurality of reflecting surfaces arranged in rows and columns and oriented at different angles with respect to the light emitting source, and the ventilation openings are in the form of slits formed between the plurality of reflecting surfaces.

In one embodiment, the body further includes an annular flange integrally formed at the major end of the truncated conical body. The annular flange is disposed on a plane perpendicular to a central axis of the truncated conical body. A plurality of additional ventilation openings is formed through the annular flange. The annular flange is thermally connected to a housing in which the heat-dissipating reflector is mounted.

The body may be formed in one piece by a die-casting process or a metal injection molding process. The body may be made of a thermally conductive metallic material.

According to another aspect, there is provided a lighting device comprising a light emitting source, and a heat-dissipating reflector having a reflecting surface for reflecting light from the light emitting source and a plurality of ventilation openings formed through the reflecting surface for dissipating heat generated by the light emitting source. In one embodiment, the light emitting source is mounted on a substrate which is in turn mounted inside a housing. The light emitting source may include a light emitting diode (LED).

According to yet another aspect, there is provided a method of manufacturing a heat-dissipating reflector for a lighting device comprising the steps of:

(a) providing a blank made of a thermally conductive metallic material; and (b) carrying out a die-cast process to form a generally truncated conical body having a reflecting surface and a plurality of ventilation openings formed through the reflecting surface, and an annular flange having a plurality of additional ventilation openings formed therethrough, the annular flange being disposed on a plane perpendicular to a central axis of the truncated conical body at a major end thereof.

According to a further aspect, there is provided a method of manufacturing a heat-dissipating reflector for a lighting device comprising the steps of:

(a) providing a mold;

(b) providing a metallic mold material; and (c) carrying out a metal injection molding process to form a generally truncated conical body having a reflecting surface and a plurality of ventilation openings formed through the reflecting surface, and an annular flange having a plurality of additional ventilation openings formed therethrough, the annular flange being disposed on a plane perpendicular to a central axis of the truncated conical body at a major end thereof.

Although the heat-dissipating reflector is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments disclosed in the application will now be described by way of example with reference to the accompanying drawings wherein.

DETAILED DESCRIPTION

Reference will now be made in detail to a preferred embodiment disclosed in the application, examples of which are also provided in the following description. Exemplary embodiments disclosed in the application are described in detail, although it will be apparent to those skilled in the relevant art that some features that are not particularly important to an understanding of the heat-dissipating reflector may not be shown for the sake of clarity.

Furthermore, it should be understood that the heat-dissipating reflector is not limited to the precise embodiments described below and that various changes and modifications thereof may be effected by one skilled in the art without departing from the scope of the claims. For example, elements and/or features of different illustrative embodiments may be combined with each other and/or substituted for each other within the scope of the appended claims.

Figure 1:
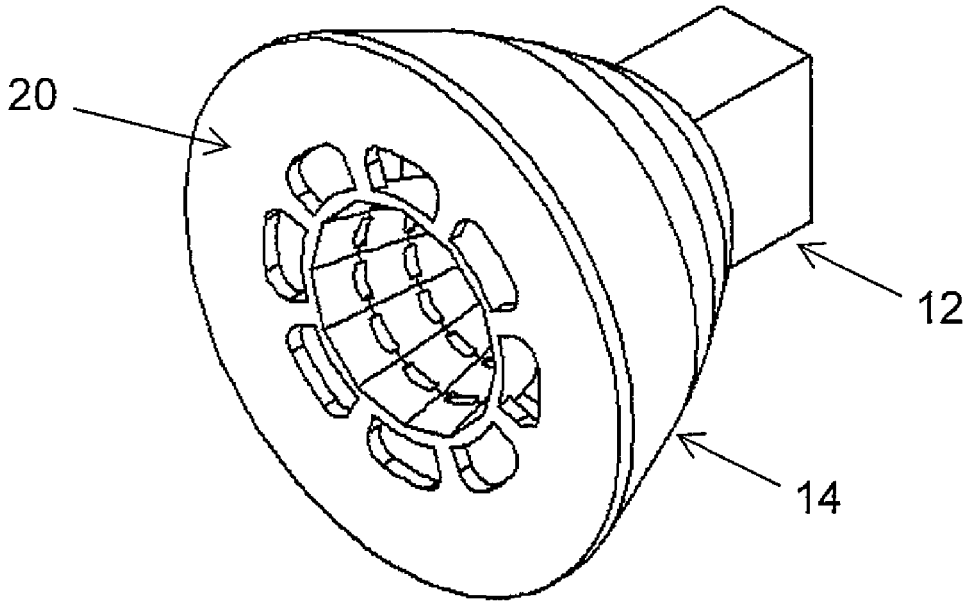
FIG. 1 is a perspective view of a LED-based spot lamp according to an embodiment disclosed in the application.
Figure 2:
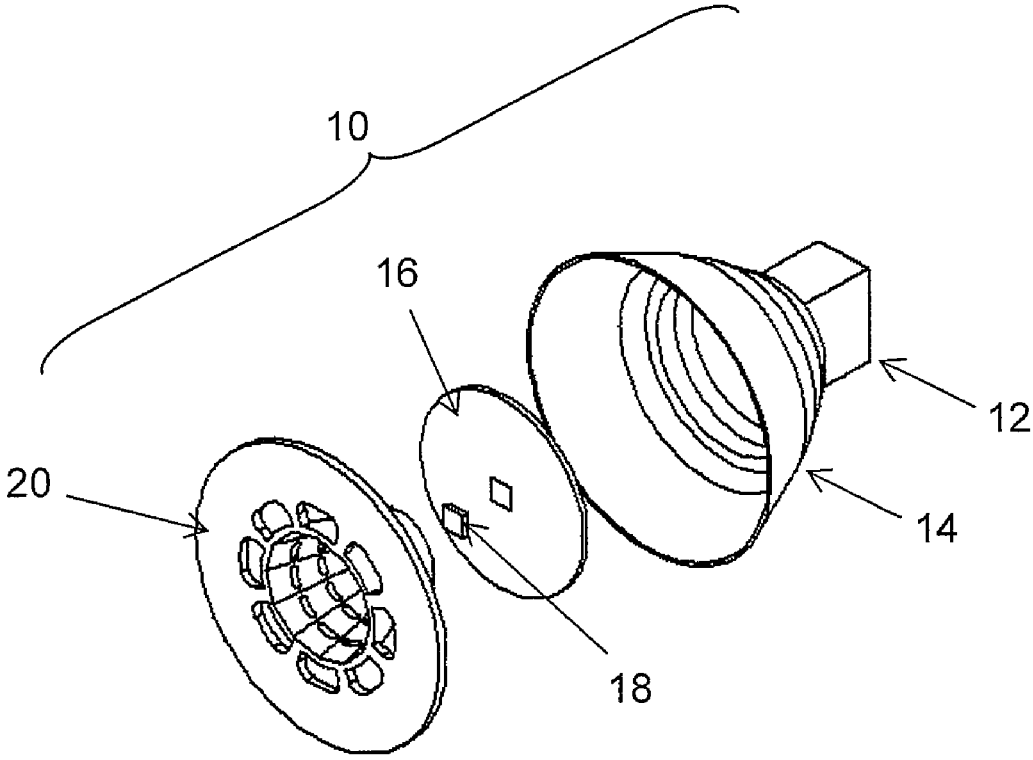
FIG. 2 is an exploded view of the LED-based spot lamp in FIG. 1.

Referring now to the drawings, FIG. 1 is a perspective view of a LED-based spot lamp 10 according to an embodiment disclosed in the application, and FIG. 2 is an exploded view of the LED-based spot lamp in FIG. 1.

The LED-based spot lamp 10 includes a plug 12, a lamp housing 14, a substrate 16, a light emitting source 18, and an opto-thermal or heat-dissipating reflector 20.

The light emitting source 18 may include a light emitting diode (LED) mounted on the substrate 16 which is in turn mounted inside the housing 14. The plug 12 serves as an electrical connector for electrically connecting the light emitting source 18 to a power source.

Figure 3:
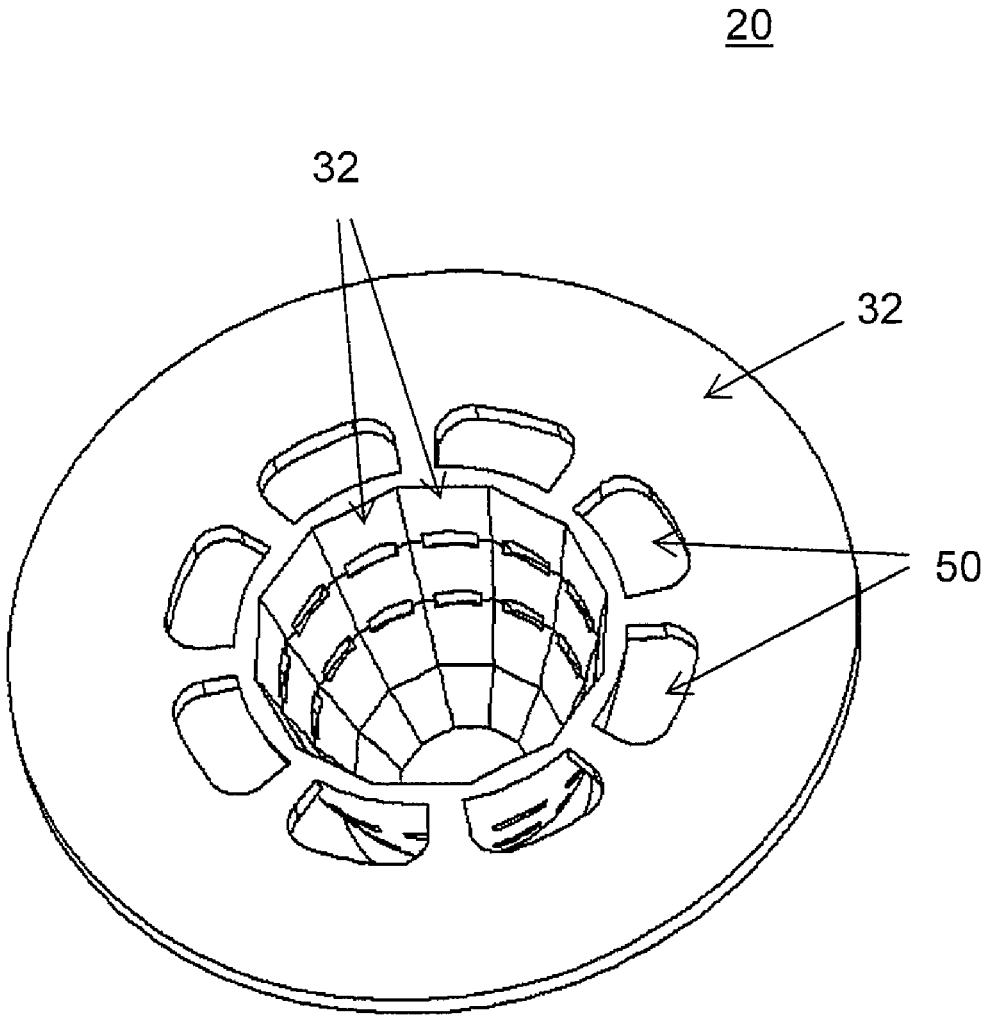
FIG. 3 is a perspective view of a heat-dissipating reflector of the LED-based spot lamp according to an embodiment disclosed in the application.
Figure 4:
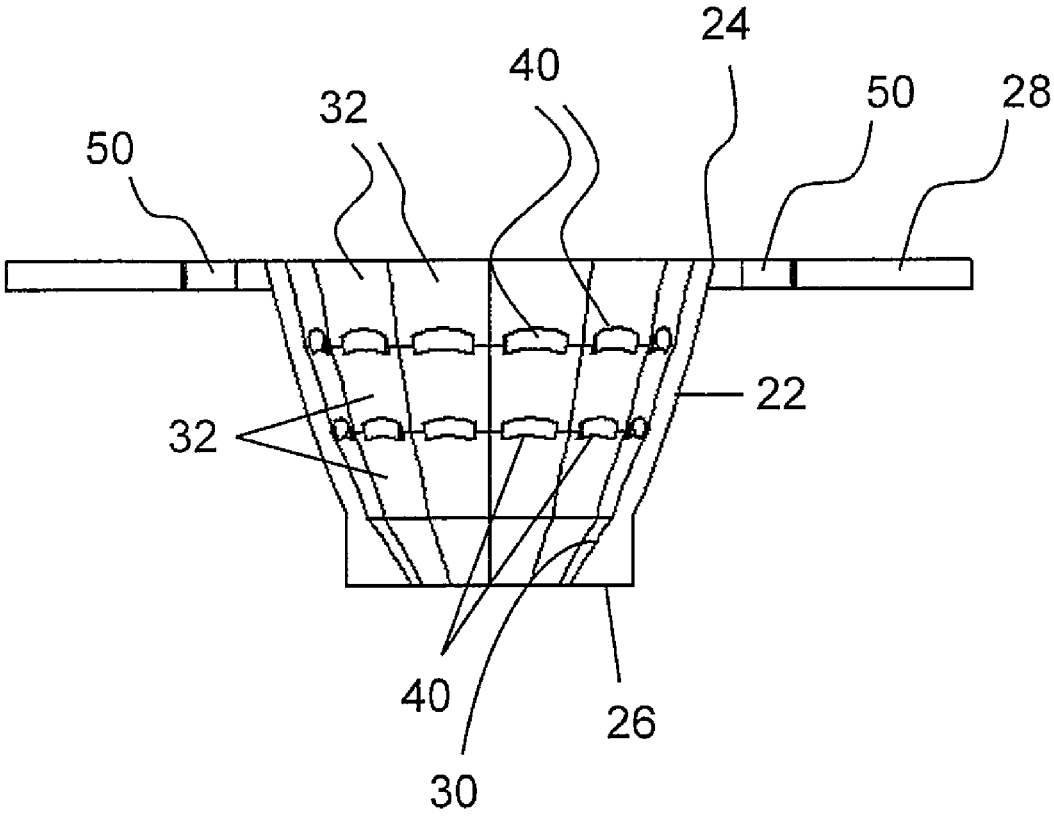
FIG. 4 is a cross sectional view of the heat-dissipating reflector of the LED-based spot lamp.

FIG. 3 is a perspective view of the heat-dissipating reflector 20 of the LED-based spot lamp 10 according to an embodiment disclosed in the application, and FIG. 4 is a cross sectional view of the heat-dissipating reflector 20.

According to the illustrated embodiment, the heat-dissipating reflector 20 has a plurality of reflecting surfaces 32 for reflecting light from the light emitting source 18, and a plurality of ventilation slits 40 formed through the reflecting surfaces 32 for dissipating heat generated by the light emitting source 18.

According to the illustrated embodiment, the heat-dissipating reflector 20 has a generally truncated conical body 22 having a major end 24 and a minor end 26, and an annular flange 28 located at the major end 24 of the truncated conical body 22. The annular flange 28 is disposed on a plane perpendicular to a central axis of the truncated conical body 22.

The heat-dissipating reflector 20 may be formed as one piece by a die-casting process, or by a metal injection molding process. Alternatively, the truncated conical body 22 and the annular flange 28 of the heat-dissipating reflector 20 may be formed separately and then joined together.

The heat-dissipating reflector 20 may be made of a thermally conductive metallic material, such as aluminum alloy.

The plurality of reflecting surfaces 32 is formed on an inner circumferential surface 30 of the truncated conical body 22. According to the illustrated embodiment, the inner circumferential surface 30 is formed into rows and columns oriented at different angles with respect to the light emitting source 18. The rows of reflecting surfaces 32 extend between the major end 24 and the minor end 26 of the truncated conical body 22. The columns of reflecting surfaces 32 extend around the inner circumferential surface 30.

Although it has been shown in the illustrated embodiment that the heat-dissipating reflector 20 has a truncated conical shape and that the plurality of reflecting surfaces 32 is a multi-facet surface, it is understood by one skilled in the art that the heat-dissipating reflector 20 may be in any other shapes and that any suitable reflecting surfaces may be employed. For example, the reflecting surface 32 can be a smooth parabolic surface.

A plurality of ventilation slits 40 is provided on the truncated conical body 22. The plurality of ventilation slits 40 may be formed through and between the plurality of reflecting surfaces 32. The ventilation slits 40 are elongating and spaced circumferentially around the truncated conical body 22.

A plurality of additional ventilation openings 50 is formed through the annular flange 28 of the heat-dissipating reflector 20 adjacent to the major end 24 of the truncated conical body 22. The size of the ventilation opening 50 may be larger than that of the ventilation slit 40.

The annular flange 28 is thermally connected to the housing 14, which is the major heat-dissipation structure of the lamp 10. This facilitates the spreading of heat generated inside the lamp 10.

Figure 5:
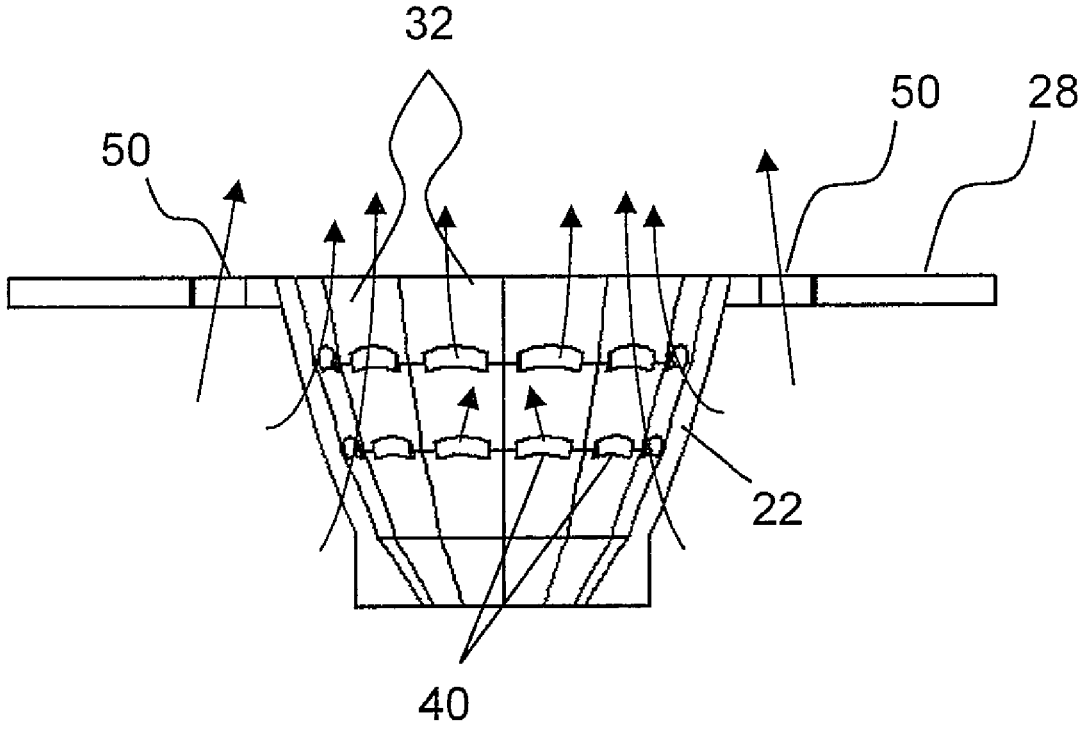
FIG. 5 is a cross sectional view of the heat-dissipating reflector similar to that in FIG. 4 showing the directions of air flow and heat dissipation.

FIG. 5 a cross sectional view of the heat-dissipating reflector similar to that in FIG. 4 showing the directions of air flow and heat dissipation.

Heat generated by the light emitting source 18 can be dissipated through the ventilation slits 40 and the additional ventilation openings 50 in the directions shown by the arrows, which are generally the same directions towards which light is directed by the reflecting surfaces 32.

While the heat-dissipating reflector has been shown and described with particular references to a number of preferred embodiments thereof, it should be noted that various other changes or modifications may be made without departing from the scope of the appended claims.

What is claimed is:

1. A lighting device comprising:

a light emitting source; and a heat-dissipating reflector having a plurality of reflecting surfaces for reflecting light from said light emitting source and a plurality of ventilation openings for dissipating heat generated by said light emitting source, wherein said ventilation openings are in the form of slits formed between said plurality of reflecting surfaces.

2. The lighting device as claimed in claim 1, wherein said heat-dissipating reflector includes a generally truncated conical body having a major end and a minor end, said reflecting surface being formed on an inner circumferential surface of said truncated conical body.

3. The lighting device as claimed in claim 2, wherein said heat-dissipating reflector further includes an annular flange integrally formed at said major end of said truncated conical body, said annular flange being disposed on a plane perpendicular to a central axis of said truncated conical body.

4. The lighting device as claimed in claim 3, wherein a plurality of additional ventilation openings is formed through said annular flange.

5. The lighting device as claimed in claim 3, further including a housing, said light emitting source being mounted on a substrate which is in turn mounted inside said housing, wherein said annular flange is thermally connected to said housing which is a major heat-dissipating structure of said lighting device.

6. The lighting device as claimed in claim 1, wherein said heat-dissipating reflector is formed by a die-casting process.

7. The lighting device as claimed in claim 1, wherein said heat-dissipating reflector is formed by a metal injection molding process.

8. The lighting device as claimed in claim 1, wherein said heat-dissipating reflector is formed in one piece.

9. The lighting device as claimed in claim 1, wherein said heat-dissipating reflector is made of a thermally conductive metallic material.

10. The lighting device as claimed in claim 1, wherein said light emitting source includes a light emitting diode.

11. A heat-dissipating reflector for a lighting device, said heat-dissipating reflector comprising a body having a reflecting surface for reflecting light from a light emitting source of the lighting device, and a plurality of ventilation openings formed through said reflecting surface for dissipating heat generated by said light emitting source, wherein said body includes a generally truncated conical body having a major end and a minor end, said reflecting surface being formed on an inner circumferential surface of said truncated conical body, and wherein said body has a plurality of reflecting surfaces, and said ventilation openings are in the form of slits formed between said plurality of reflecting surfaces.

12. The heat-dissipating reflector as claimed in claim 11, wherein a plurality of additional ventilation openings is formed through said annular flange.

13. A method of manufacturing a heat-dissipating reflector for a lighting device comprising the steps of:

providing a blank made of a thermally conductive metallic material; and carrying out a die-cast process to form a generally truncated conical body having a reflecting surface and a plurality of ventilation openings formed through said reflecting surface, and an annular flange having a plurality of additional ventilation openings formed therethrough, said annular flange being disposed on a plane perpendicular to a central axis of said truncated conical body at a major end thereof.

14. A method of manufacturing a heat-dissipating reflector for a lighting device comprising the steps of:

providing a mold;

providing a metallic mold material; and carrying out a metal injection molding process to form a generally truncated conical body having a reflecting surface and a plurality of ventilation openings formed through said reflecting surface, and an annular flange having a plurality of additional ventilation openings formed therethrough, said annular flange being disposed on a plane perpendicular to a central axis of said truncated conical body at a major end thereof.

* * * * *